US008307763B2

(12) United States Patent
Al-Awadhi et al.

(10) Patent No.: US 8,307,763 B2
(45) Date of Patent: Nov. 13, 2012

(54) CAN CRUSHER

(75) Inventors: Hanan M. Al-Awadhi, Kuwait (KW); Mohammed Al-Essa, Kuwait (KW); Ahmed Al-Jama'an, Kuwait (KW); Abdulwahab Al-Qabandi, Kuwait (KW)

(73) Assignee: Kuwait University, Safat (KW)

( * ) Notice: Subject to any disclaimer, the term of this patent is extended or adjusted under 35 U.S.C. 154(b) by 255 days.

(21) Appl. No.: 12/801,284

(22) Filed: Jun. 1, 2010

(65) Prior Publication Data

US 2010/0236430 A1 Sep. 23, 2010

Related U.S. Application Data

(63) Continuation-in-part of application No. 11/456,378, filed on Jul. 10, 2006, now abandoned.

(51) Int. Cl.
*B30B 1/00* (2006.01)
*B30B 9/32* (2006.01)

(52) U.S. Cl. ..... 100/280; 100/245; 100/266; 100/902

(58) Field of Classification Search ..... 100/215, 100/218, 240, 245, 260, 265, 266, 269.01, 100/270, 271, 269.17, 282, 295, 902, 280
See application file for complete search history.

(56) References Cited

U.S. PATENT DOCUMENTS

| | | | | |
|---|---|---|---|---|
| 2,817,290 A | | 12/1957 | Parker et al. | |
| 2,916,985 A | * | 12/1959 | Beach | 100/345 |
| 3,025,837 A | * | 3/1962 | Beach | 91/4 R |
| 4,442,767 A | * | 4/1984 | Johnson | 100/116 |
| 4,483,248 A | * | 11/1984 | Ostreng | 100/99 |
| 5,768,988 A | | 6/1998 | Meloni | |
| 5,787,564 A | * | 8/1998 | Herpst et al. | 29/463 |
| 2005/0139093 A1 | * | 6/2005 | Nelson et al. | 100/37 |

* cited by examiner

*Primary Examiner* — Jimmy T Nguyen
(74) *Attorney, Agent, or Firm* — Richard C. Litman

(57) ABSTRACT

The can crusher is a device capable of crushing aluminum and steel cans. The device incorporates a wheeled base that supports thereon an assembly that includes a container for housing the cans and mechanisms for crushing the cans. The crushing mechanisms include a hydraulic jack, a sliding crank system, extension springs, a single-phase, geared motor, a movable plate and a pressure gauge.

9 Claims, 5 Drawing Sheets

CAN CRUSHER

CROSS-REFERENCE TO RELATED APPLICATION

This application is a continuation-in-part of U.S. patent application Ser. No. 11/456,378 filed on Jul. 10, 2006, now abandoned, which is herein incorporated by reference in its entirety.

BACKGROUND OF THE INVENTION

1. Field of the Invention

The present invention generally relates to compacting devices, and particularly to a can crusher for compacting or crushing aluminum and steel cans.

2. Description of the Related Art

The world is currently producing large volumes of trash. It is desirable to condense or crush some types of trash to reduce the space requirement for disposal, as well as to prepare some of it for recycling. Solid waste reduction means that the world becomes more environmentally friendly.

Aluminum cans are the real success story of the recycling movement. By far, the most valuable component in the consumer waste stream, they enjoy the greatest public recognition as recycled household items. With historical values from $0.35 to $0.75 per pound, aluminum cans are often the economic backbone of municipal and private recycling programs. Aluminum cans are collected in a variety of ways, e.g., through deposit schemes, buy-back collection mechanisms, and blue box programs wherein household recyclables are picked up at the curb and taken to large recycling facilities.

In recent years, the steel can manufacturing industry has been aggressively addressing the recycling of all of the many different types of steel cans. Thanks to their efforts, steel can recycling rates have quickly risen across the western world. Because of steel's unique magnetic properties, collection of steel cans is relatively simple, relieving the consumer of much of the burden of separation. More than 28 percent of a new steel can is made from recycled steel. Aluminum cans were recycled at a rate of 63.5 percent. After collection, the cans are shipped to processing plants to be recycled. The recycling industry would certainly welcome a device that could efficiently crush the cans, thereby reducing volume and the costs of shipping. Such a device would be a valuable addition in many venues (restaurants, stores, hospitals, etc.). Thus, a can crusher solving the aforementioned problems is desired.

SUMMARY OF THE INVENTION

The can crusher is a device that is capable of crushing aluminum and steel cans. The device incorporates a wheeled base that supports thereon an assembly that includes a container for housing the cans and mechanisms for crushing the cans. The crushing mechanisms include a hydraulic jack, a sliding crank system, extension springs, a single-phase, geared motor, a movable plate, and a pressure gauge.

Accordingly, the invention presents a portable assembly that can efficiently reduce the size of metal cans for recycling purposes. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
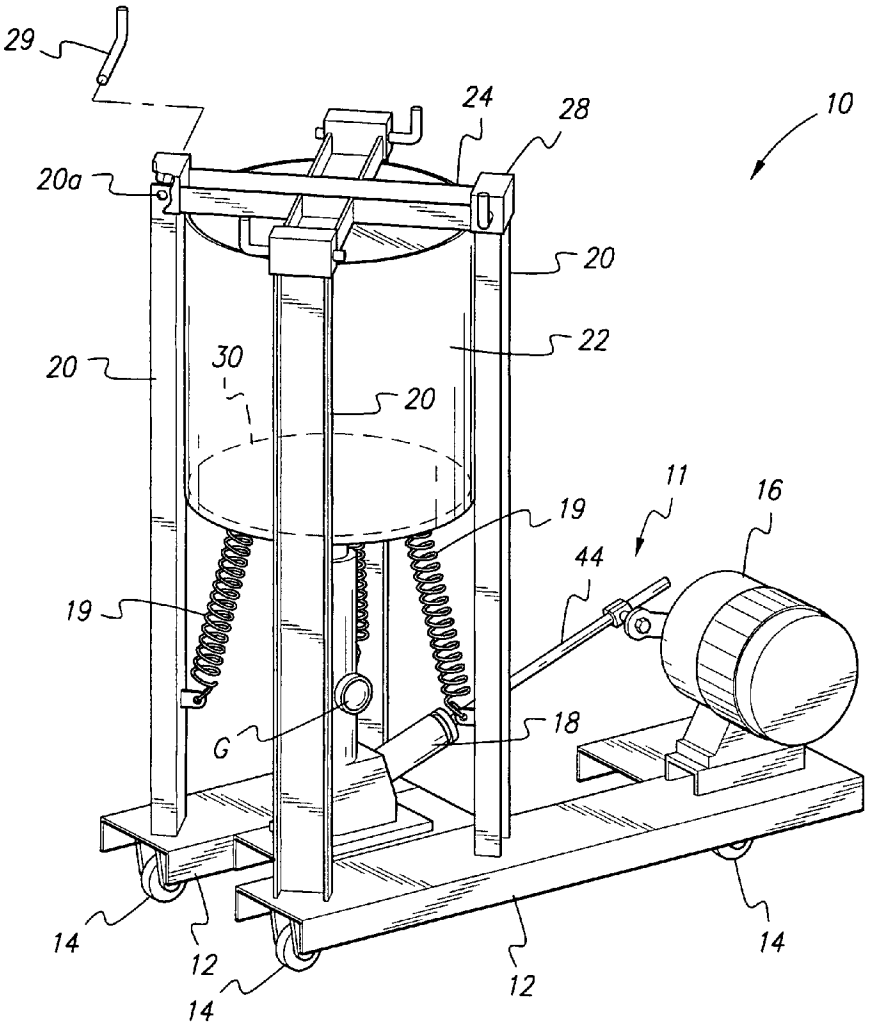
FIG. 1 is a perspective view of a can crusher according to the present invention.

Referring to FIG. 1, the can crusher 10 comprises a base 12, which is preferably fabricated from U-shaped metal stock. A plurality of wheels 14 is mounted to the undersurface of the base to enhance portability thereof. A geared, single-phase, electric motor 16 and a hydraulic jack 18 are disposed upon and attached to the upper surface of the base 12. A sliding crank mechanism, generally indicated at 11, connects the motor 16 to the hydraulic jack 18. The jack 18 is provided with a pressure gauge G for purposes that will be explained below. A plurality of U-shaped support members 20 are attached at their lower ends to base 12 and extend vertically therefrom. The upper ends of the support members 20 are provided with respective openings 20*a* for receiving a locking pin, as explained below. A container 22 for housing cans to be crushed is supported on the support members 20. The container 22 is provided with an open top, which is closable by a removable upper plate 24. A lower plate 30 is nested within container 22 and closes the bottom thereof. The lower plate 30 is vertically movable or slidable in the container 22. Although a cylindrical configuration is preferred, it should be recognized that the container 22 could be fabricated in other suitable configurations. Tension springs 19 are attached at their upper ends to hooks disposed on the bottom surface of the lower plate 30. The lower ends of the tension springs 19 are attached to respective vertical support members 20. The tension springs 19 bias the lower plate 30 to a position at or near the bottom of the container 22.

Figure 2:
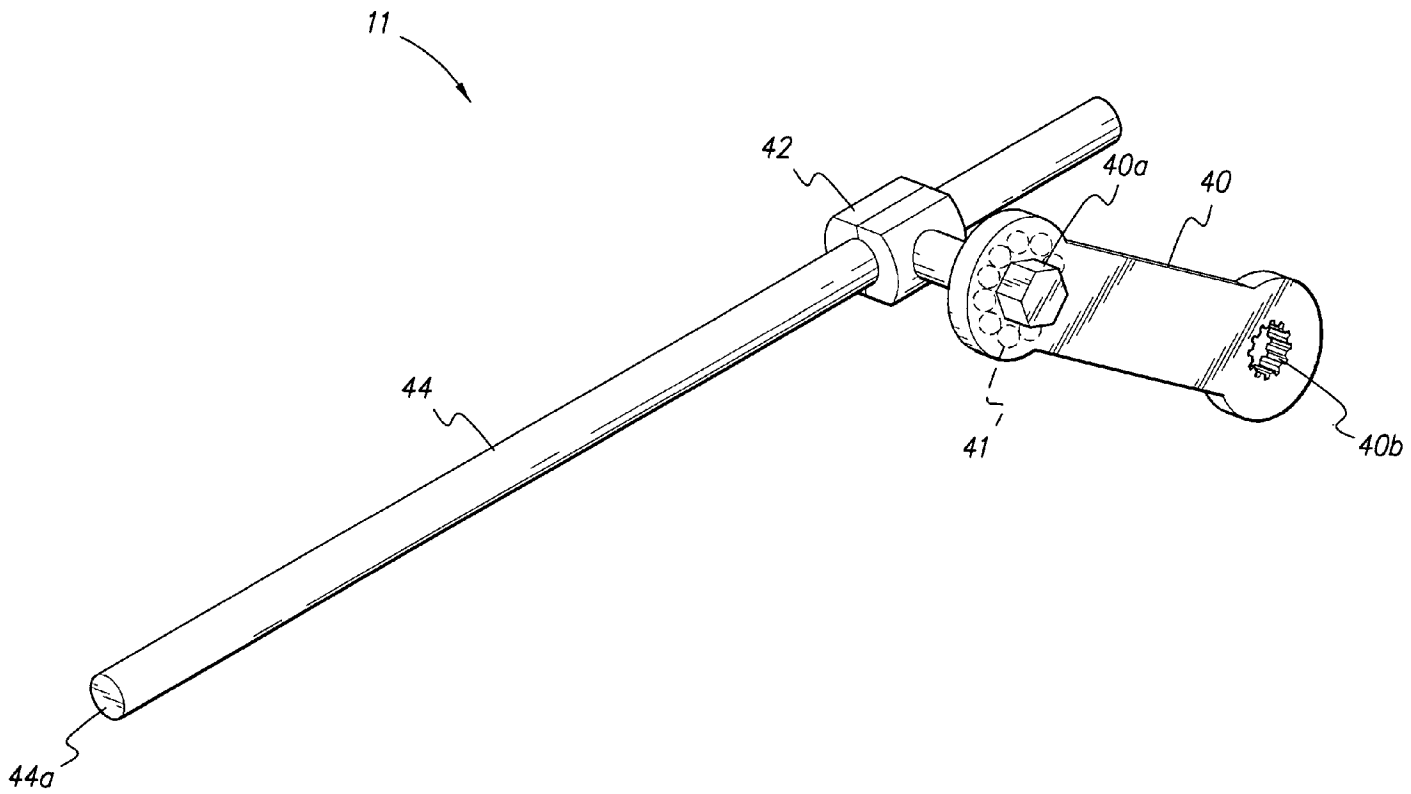
FIG. 2 is a perspective view of a sliding crank mechanism for a can crusher according to the present invention.

As best seen in FIG. 2, the sliding crank mechanism 11 comprises a link 40 having openings 40*a* and 40*b* formed at opposite ends thereof. The opening 40*a* is adapted to receive the shaft of a slider assembly 42. The slider assembly 42 moves back and forth along a lever 44. The proximate end 44*a* of the lever 44 is attached to the jack 18. The opening 40*b* is attached to the drive shaft of the motor 16. A ball bearing assembly 41 (shown in phantom lines) is provided at the opening 40*a* to enhance rotating movement. The sliding crank mechanism 11 is fabricated from a strong, durable material, preferably steel, to withstand the bending stresses encountered in the crushing operation, as described below. Levers of different lengths may be employed, depending on the desired length of the stroke applied to the jack 18.

Figure 3A:
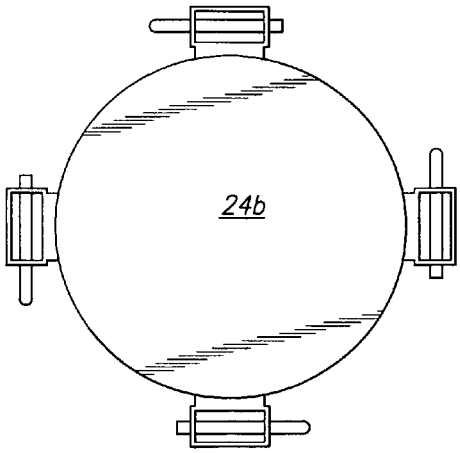
FIG. 3A is a bottom view of an upper plate for a can crusher according to the present invention.
Figure 3B:
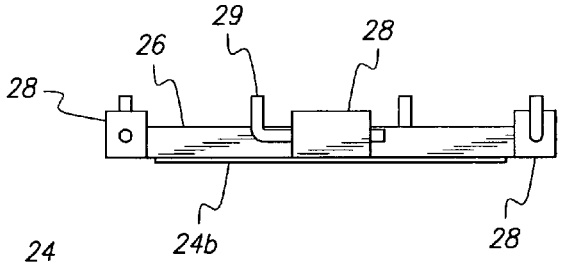
FIG. 3B is a side view of the upper plate of FIG. 3A.
Figure 3C:
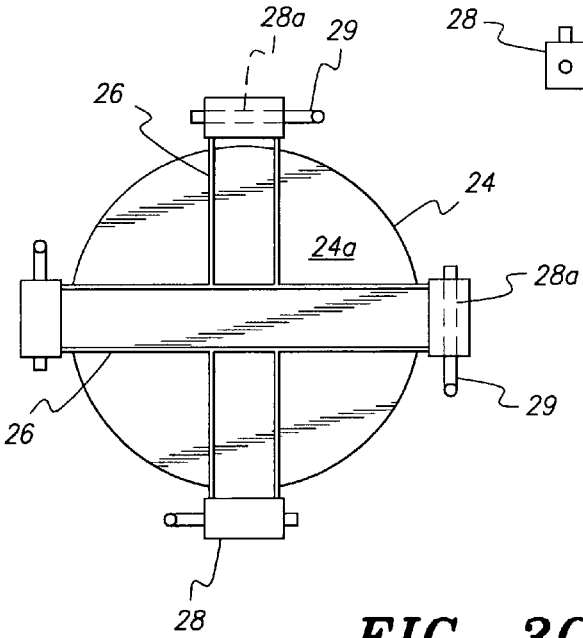
FIG. 3C is a top view of the upper plate of FIG. 3A.

As indicated above, the removable upper plate 24 is designed to close the open top of container 22. As best illustrated in FIGS. 3A-3C, the upper surface 24*a* of the upper plate 24 is provided with two U-shaped reinforcement members 26, preferably welded thereon. The reinforcement members 26 are arranged perpendicular to each other and have ends that terminate slightly beyond the perimeter of the upper plate 24. Each respective end is provided with a block member 28 attached thereto, preferably by welding. A respective opening 28*a* is formed in each block 28 for receiving a respective locking pin 29 therethrough. The bottom surface 24*b* presents a smooth planar surface.

Figure 4A:
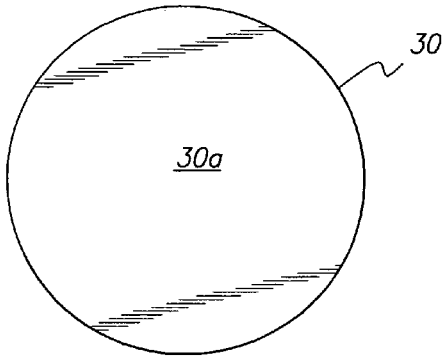
FIG. 4A is a top view of a lower plate for a can crusher according to the present invention.
Figure 4B:
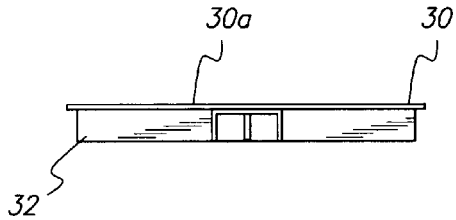
FIG. 4B is a side view of the lower plate of FIG. 4A.
Figure 4C:
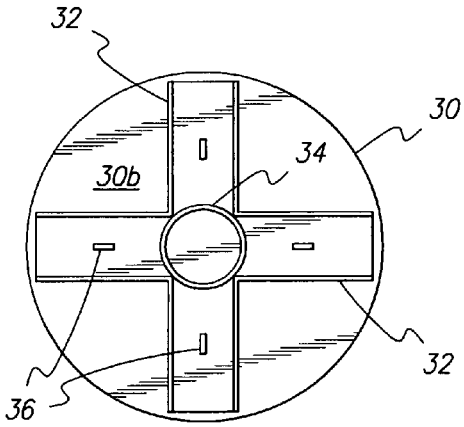
FIG. 4C is a bottom view of the lower plate of FIG. 4A.

As best seen in FIGS. 4A-4C, the bottom plate 30 presents a smooth planar upper surface 30*a*. The undersurface 30*b* is provided with U-shaped, perpendicularly arranged reinforcement members 32, which are preferably welded to the undersurface 30*b*. A socket 34 is positioned at the center of the plate 30. The socket 34 receives the upper end of the piston of the hydraulic jack 18. Hooks 36 disposed for receiving the respective upper ends of tension springs 19.

Figure 5:
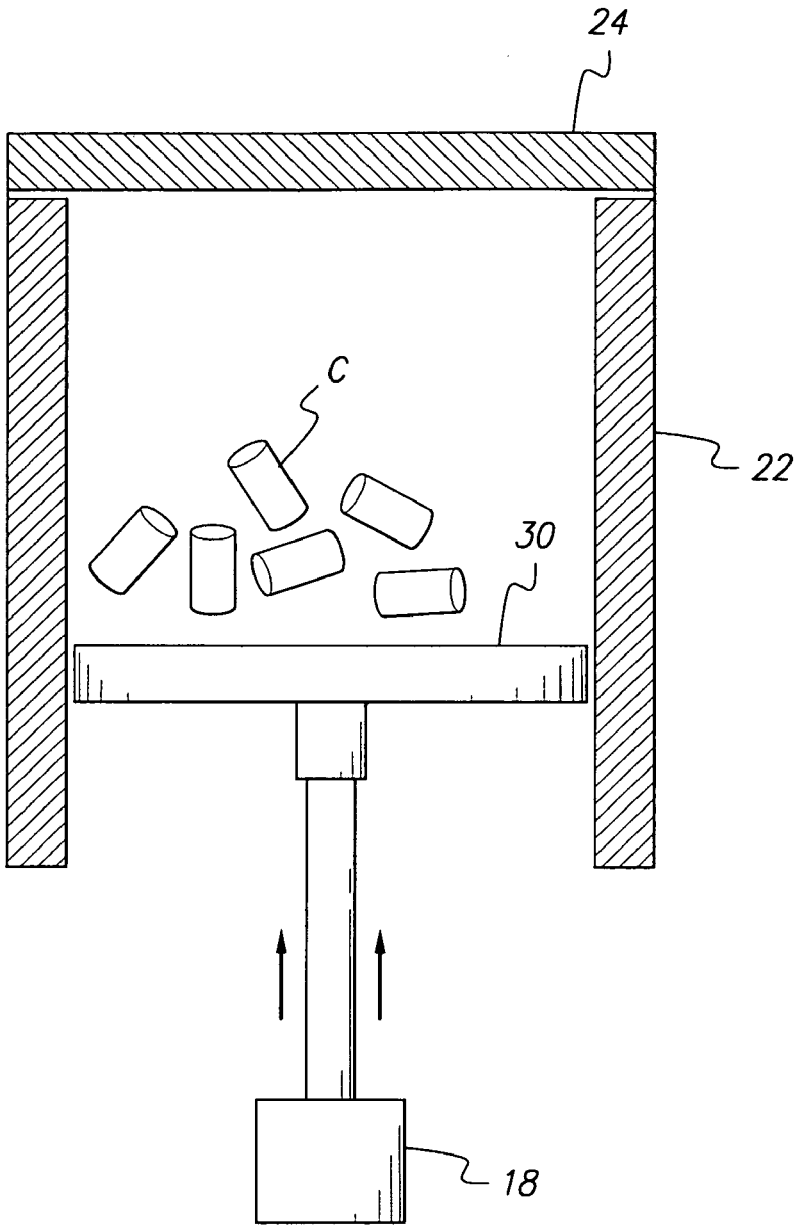
FIG. 5 is a partial, schematic view showing the operational function of a can crusher according to the present invention.

In use, as schematically shown in FIG. 5, the upper plate 24 is removed from the container 22, and cans C to be crushed are placed therein. The upper plate 24 is repositioned on the housing, and the pins 29 are inserted through the openings in the blocks 28 and the support members 20 to firmly secure the upper plate 24 on top of the container 22. The motor 16 is activated and functions to cause the slider crank mechanism 11 to move the lever 44 in an up and down motion to drive the handle of the jack 18, raising the piston of the jack 18 and the lower plate 30 upward, whereby cans C are crushed against the upper plate, as shown schematically in FIG. 5. The gauge G will allow monitoring of the load generated in the jack 18 to prevent an unsafe amount of force from being applied. After crushing is completed, tension springs 19 will return the lower plate to its original position.

It is to be understood that the present invention is not limited to the embodiment described above, but encompasses any and all embodiments within the scope of the following claims.

We claim:

1. A can crusher, comprising:

a base member having an upper surface and an undersurface;

a plurality of support members disposed on the upper surface of the base, the support members and extending upward therefrom, said plurality of support members comprising a plurality of U-shaped beams having lower ends attached to the upper surface of said base;

a container adapted for housing cans to be crushed, the container having an open top and a bottom, the container being mounted to the plurality of support members;

an upper plate member removably mounted on the open top for optionally closing the open top;

reinforcement members disposed on an upper surface of said upper plate member, the reinforcement members arranged perpendicular to each other and have ends that terminate adjacent to a perimeter of said upper plate member, each respective end of said reinforcement members is provided with a block member, wherein upper ends of said plurality of U-shaped beams are detachably secured to said upper plate member via said block members;

a lower plate member closing the bottom of the container, the lower plate member being slidably movable in the container;

a driving system mounted on the upper surface of the base, the driving system being connected to the lower plate and operable to slidably move the lower plate member in the container toward the upper plate member to crush the cans housed in the container; and a plurality of springs having respective upper ends mounted to the lower plate member and respective lower ends mounted to the plurality of support members, the springs biasing the lower plate member towards the bottom of the container.

2. The can crusher according to claim 1, wherein said driving system includes a hydraulic jack, an electric motor, and a sliding crank mechanism connecting the electric motor to the hydraulic jack.

3. The can crusher according to claim 1, further including a plurality of wheels mounted to the undersurface of said base.

4. The can crusher according to claim 1, wherein said container is configured as a cylinder.

5. The can crusher according to claim 1, wherein said lower plate has an undersurface and further includes reinforcing structure disposed on the undersurface of said lower plate.

6. A can crusher, comprising:

a base member having an upper surface and an undersurface;

a plurality of U-shaped beam support members having lower ends attached to the upper surface of the base member, the support members extending upward from the base;

a container adapted for housing cans to be crushed, the container having an open top and a bottom, the container being mounted to the plurality of U-shaped beam support members;

an upper plate member removably mounted on the open top for selectively closing the open top, the upper plate member having an upper surface;

reinforcement members disposed on the upper surface of said upper plate member, the reinforcement members arranged perpendicular to each other and have ends that terminate adjacent to a perimeter of the upper plate member, each respective end of said reinforcement members is provided with a block member, wherein upper ends of said plurality of U-shaped beams are detachably secured to said upper plate member via said block members;

a lower plate member closing the bottom of the container, the lower plate member being slidably movable within the container, the lower plate member having an undersurface;

reinforcement structure disposed on the undersurface of the lower plate member;

a driving system mounted on the upper surface member of the base, the driving system being connected to the undersurface of the lower plate member and operable to slidably move the lower plate member in the container toward the upper plate member to crush the cans housed in the container; and a plurality of springs having respective upper ends mounted to the undersurface of the lower plate member and respective lower ends mounted to the plurality of U-shaped support members, the springs biasing the lower plate member towards the bottom of the container.

7. The can crusher according to claim 6, wherein said driving system includes a hydraulic jack, an electric motor, and a sliding crank mechanism connecting the electric motor to the hydraulic jack.

8. The can crusher according to claim 6, further including a plurality of wheels mounted to the undersurface of said base.

9. The can crusher according to claim 6, wherein said container is configured as a cylinder.

* * * * *